United States Patent [19]

Clynes

[11] Patent Number: 4,704,682

[45] Date of Patent: Nov. 3, 1987

[54] COMPUTERIZED SYSTEM FOR IMPARTING AN EXPRESSIVE MICROSTRUCTURE TO SUCCESSION OF NOTES IN A MUSICAL SCORE

[76] Inventor: Manfred Clynes, 9/5 Longworth Avenue, Point Piper, Sydney, Australia, 2027

[21] Appl. No.: 552,075

[22] Filed: Nov. 15, 1983

[51] Int. Cl.[4] ..... G10F 1/00; G10H 7/00

[52] U.S. Cl. ..... 364/419; 84/1.03; 84/1.19; 84/1.24

[58] Field of Search ..... 364/419; 84/1.03, 1.19, 84/1.24, 1.25, 1.26, 1.27, DIG. 12, DIG. 4, DIG. 5

[56] References Cited

U.S. PATENT DOCUMENTS

| | | | |
|---|---|---|---|
| 3,881,387 | 5/1975 | Kawakami | 84/1.25 X |
| 3,956,960 | 5/1976 | Deutsch | 364/419 X |
| 3,972,259 | 8/1976 | Deutsch | 364/419 X |
| 4,022,097 | 5/1977 | Strangio | 84/1.03 |
| 4,026,180 | 5/1977 | Tomisawa et al. | 84/1.25 |
| 4,058,043 | 11/1977 | Shibahara | 84/464 X |
| 4,177,706 | 12/1979 | Greenberger | 364/718 X |
| 4,329,902 | 5/1982 | Love | 84/1.25 |
| 4,344,347 | 8/1982 | Faulkner | 364/722 X |
| 4,378,720 | 4/1983 | Nakada et al. | 84/1.03 |
| 4,391,176 | 7/1983 | Niinomi et al. | 84/1.25 X |
| 4,417,494 | 11/1983 | Nakada et al. | 84/1.03 |
| 4,476,766 | 10/1984 | Ishii | 84/1.03 |
| 4,492,142 | 1/1985 | Oya et al. | 84/1.03 |

OTHER PUBLICATIONS

Ward, Brice, *Electronic Music Circuit Guidebook,* TAB Books, Blue Ridge Summit, PA, 1975, 27–29.

Clynes, Manfred, "Secrets of Life in Music," *Analytica,* Mar. 1985, 3–15.

Clynes, Manfred, "Music Beyond the Score," *Somatics,* vol. 1, No. 5, Autumn–Winter 1985, 4–14.

Beyer, William H. (Editor), *CRC Standard Mathematical Tables,* 26th Edition, The Beta Function, CRC Press, Inc., Boca Raton, Fla., 1981, 400.

*Primary Examiner*—Joseph Ruggiero
*Assistant Examiner*—Clark A. Jablon
*Attorney, Agent, or Firm*—Michael Ebert

[57] ABSTRACT

A computerized system into which is fed the nominal values of a musical score, the system acting to process these values with respect to the amplitude contour of individual tones, the relative loudness of different tones in a succession thereof, changes in the duration of the tones and other deviations from the nominal values which together constitute the microstructure of the music notated by the score. The system yields the specified tones of the score as modified by the microstructure, thereby imparting expressivity to the music that is lacking in the absence of the microstructure.

8 Claims, 13 Drawing Figures

$P_1, P_2$ VALUES, STARTING FROM SYMMETRICAL CURVE 1.0, 1.0
1.1, .9
1.2, .8
1.3, .7
1.4, .6
1.6, .5
1.8, .4
2.2, .3
3 , .2
4 , .1
(P)

$P_1, P_2$ VALUES, STARTING FROM SYMMETRICAL CURVE 1.0, 1
.9, 1.1
.8, 1.2
.7, 1.3
.6, 1.4
.5, 1.6
.4, 1.8
.3, 2.2
.2, 3
.1, 4
(A)

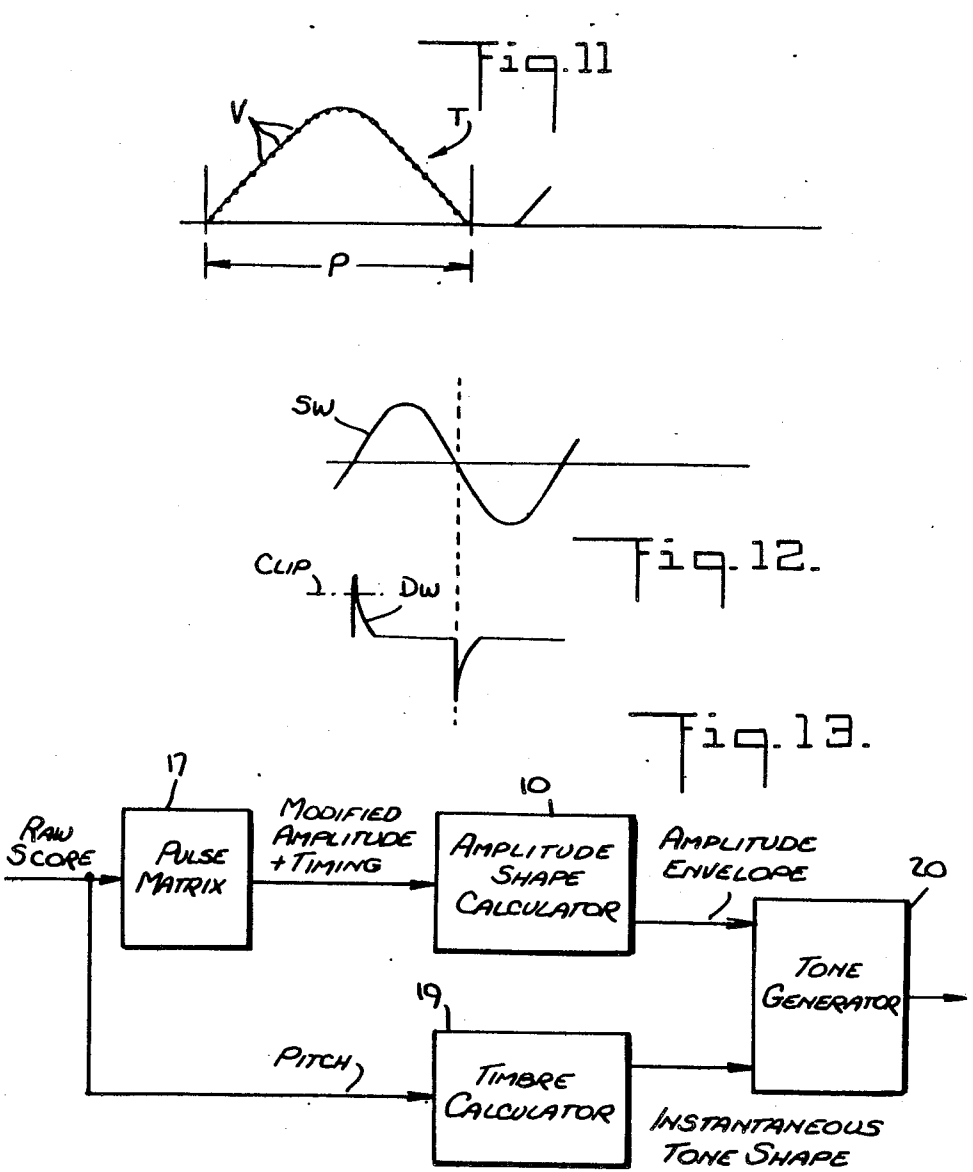
Fig. 11
T
V
P
Fig. 12.
SW
CLIP
DW
Fig. 13.
RAW SCORE
PULSE MATRIX
17
MODIFIED AMPLITUDE + TIMING
AMPLITUDE SHAPE CALCULATOR
10
AMPLITUDE ENVELOPE
TONE GENERATOR
20
PITCH
TIMBRE CALCULATOR
19
INSTANTANEOUS TONE SHAPE
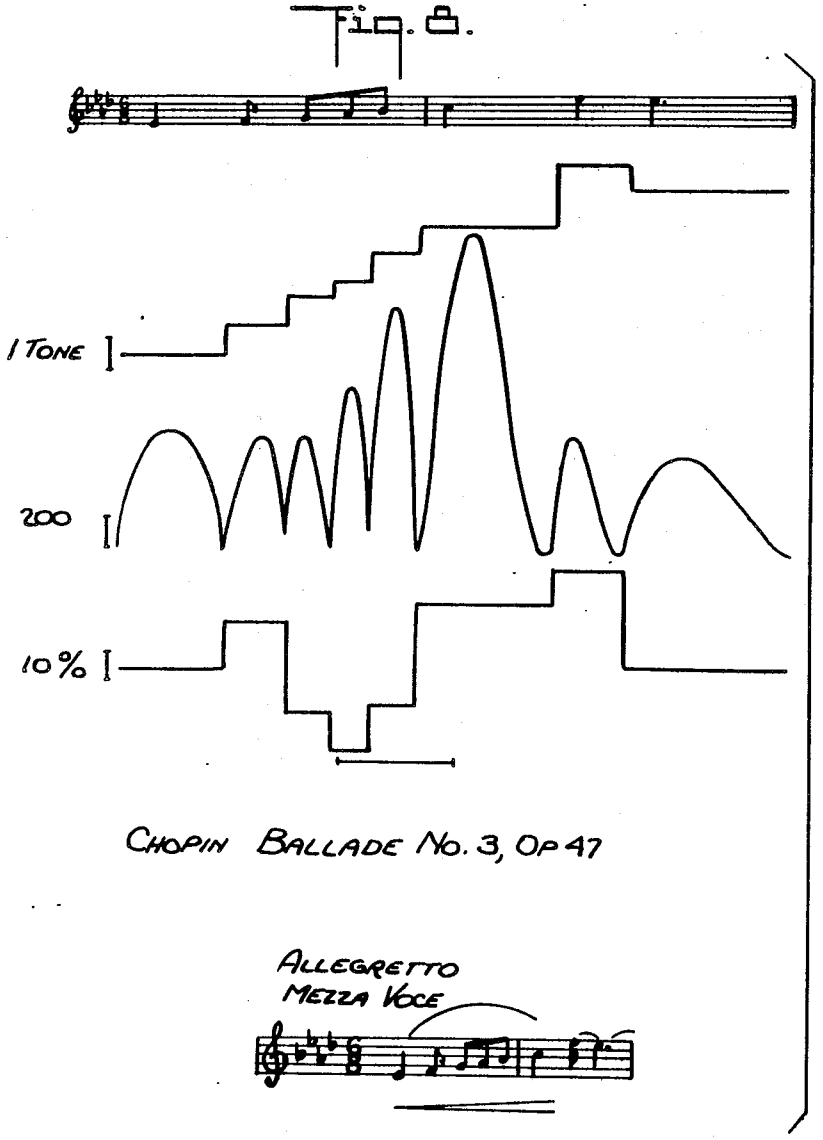
Fig. 8.
1 TONE
200
10%
CHOPIN BALLADE No. 3, OP 47
ALLEGRETTO
MEZZA VOCE

COMPUTERIZED SYSTEM FOR IMPARTING AN EXPRESSIVE MICROSTRUCTURE TO SUCCESSION OF NOTES IN A MUSICAL SCORE

BACKGROUND OF INVENTION

1. Field of Invention:

This invention relates generally to a technique for manipulating the nominal notational values of a musical score with respect to the amplitude contour of individual tones, the relative loudness of different tones, slight changes in tone duration and other deviations from the nominal values which together constitute the expressive microstructure of music. More particularly, the invention deals with a computerized system capable of manual or automatic operation for impressing an expressive microstructure on a musical score inputted therein in terms of nominal notational values, the system being usable for composing music that includes microstructure.

Music has been defined as the art of incorporating intelligible combinations of tones into a composition having structure and continuity. A melody is constituted by a rhythmic succession of single tones organized as an aesthetic whole. The standard system of notation employs characters to indicate tone, the duration of a tone (whole, half, quarter, etc.) being represented by the shape of the character and the pitch of each tone by the position of the character on the staff. In such notation, a melody is a musical line as it appears on the staff when viewed horizontally.

While the notation of a musical score gives the nominal values of the tones, in order for a performer to breathe expressive life into the composition, he must read into the score many subtilties or nuances that are altogether lacking in standard notation. Some expressive subtilties are introduced as a matter of accepted convention, but most departures from the nominal values appearing in the score depend on the interpretive power of the performer.

Thus, a musical score, while it may indicate whether a section of the score is to be played loudly (forte) or softly (piano), does not generally specify the relative loudness of component tones either of a melody or of a chord with anything approaching the degree of discrimination required by the performer. The performer decides for himself how loudly specific notes are to be played to render the music expressive.

Even more important to an effective performance is the amplitude contour of each tone in the succession thereof. To satisfy musical requirements, the amplitudes of the tones must be individually shaped. Though, in general, amplitude contours are completely unspecified in standard notation, each performer, such as a singer or violinist, who has the freedom to shape tones, does so in actual performance to impart expressivity thereto. Indeed, with those instruments that lend themselves to tone shaping, variations in the amplitude shapes of the tones constitute a principal means of expression in the hands of an expert performer.

Another factor which comes into play in the microstructure of music are subtle deviations from the temporal values prescribed in the score. Thus, in actual performance, to avoid temporal rigidity which dehumanizes music, the performer will in actual practice amend the nominal duration values indicated by standard notation. These nominal values are arithmetic ratios of simple whole numbers such as $\frac{1}{2}$, $\frac{1}{3}$, $\frac{1}{4}$, 1/16, etc.

Yet another expressive component of music which is unspecified in the score is the timbre to be imparted to each tone; that is, the harmonic content thereof. A performer of a string instrument, by varying the pressure and velocity of the bow on the string, can give rise, not only to variations in the loudness of the tone, but also variations in its tonal timbre independently of loudness. On a wind instrument, the performer can achieve similar effects by changes in lip pressure and wind velocity.

In short, the macrostructure of a musical composition is defined in the score by standard notation. If, therefore, one executes this score by being assiduously faithful to its macrostructure, the resultant performance, however expertly executed, will be bereft of vitality and expression. The term "microstructure" as used herein encompasses all subtle deviations from the nominal values of the macrostructure in terms of amplitude shaping, timing, timbre and all other factors which impart expressiveness to music.

It has been found that the measure of expressivity that can be attained using only sinusoidally-generated tones whose amplitude is shaped is quite surprising, despite the absence of harmonics which enrich the tones. Our ears appear to be highly sensitive to changing amplitudes and shapes, and our memories can effortlessly detect relative amplitudes and amplitude-shapes sounded in sequence in a musical context, even when the corresponding tones are sounded up to 10 or 15 seconds apart with many other tones in between.

This faculty of short term memory for comparing tone amplitudes and tone shapes makes it possible for the typical listener to distinguish between identical forms that are mostly perceived as mechanical and monotonous, and slightly varying forms; for the latter, played even a few seconds apart, are perceived in relationship to one another and can produce varied meaning and vitality. Thus, the relationships which constitute the microstructure in music, though not explicit in the score, are vital to its appreciation.

Essential also to an understanding of controllable microstructure in a system in accordance with the invention are A essentic forms; that is, the dynamic expressive forms of specific emotions; and B, the inner pulse of composers. These will now be separately considered.

As explained in an article by Clynes and Nattheim (pp47–82) included in Music, Mind and Brain: The Neuropsychology of Music, M. Clynes (ed.), Plenum Press, New York (1982), touch expressions of specific emotions such as love, grief and hate, can be transformed into sound expressions of like emotions; i.e., the nature of the transforms was found so that the sound expresses the same emotional quality as the touch expression from which it is transformed.

The touch expressions are measured by recording the transient forms of finger pressure when these are voluntarily expressed. The instrument enabling this measurement to be made is called the Sentograph; it measures both the vertical and horizontal components of finger pressure independently as vector components varying with time. The sentographic forms obtained are stored in a computer memory and can be reproduced at will. (See Clynes patent No. 3,755,922, "System for Producing Personalized Sentograms" which discloses in greater detail the nature of essentic forms and how sentographs are produced.)

In transforming the sentograms for touch expression of specific emotions into corresponding sound expressions it was found that the dynamic form (essentic form) of the touch was preserved to become the frequency contour of the sound. The sound is a frequency and amplitude modulated sinusoid. The amplitude modulation also was related to the dynamic touch form but needed to be passed through an imperfect differential network.

These expressive sound shapes of "continuous" frequency modulation are related to melodies which represent a form of "discrete" frequency modulation. As spelled out in the above-identified Clynes and Nattheim article, it is possible to create musical melodies which express an emotional quality similar to dynamic, expressive sound forms in such a way that the melodic steps of the created melody act to outline the frequency contour of the "continuous" form, and the amplitude contour of the expressive sound is preserved. As different melodic steps are chosen, the durations would be constrained so as to conform to the "continuous" frequency modulation wave. (essentic form).

The inner pulse of specific composers such as Beethoven, Mozart and Schubert, are expressed by sentographic forms obtained by having an individual think the music of a selected composer in his mind and by concurrently expressing the pulse by "conducting the music on a sentograph with finger pressure. The resultant sentograms indicate that major composers, such as those previously identified, impart individual pulse forms to their music which characterize their creativity identity or personal idiom. This inner pulse characteristic of each composer is, to a degree, analogous to individualistic brush strokes which distinguish one painter from another, regardless of the subject matter of their paintings. (See M. Clynes, "Sentics, The Touch of Emotions" - published by Doubleday - 1977.)

SUMMARY OF INVENTION

In view of the foregoing, the main object of this invention is to provide a computerized system for processing the nominal values of a musical score to impart an expressive microstructure thereto.

More particularly, an object of the invention is to provide a system of the above type which is operable in a manual mode in which the values representing the microstructure are entered by the user, or in the automatic mode wherein microstructure values are calculated from a shaping function responsive to the melodic contour and by means of pulse matrices having certain values relating to the amplitude and duration of pulse component tones stored in the system.

Among the significant advantages of a system in accordance with the invention is that it makes it possible to enliven a musical score and render it highly expressive, the system thereby acting to deepen the user's understanding and appreciation of music and its structure.

Briefly stated, these objects are attained in a computerized system into which is fed the nominal values of a musical score, the system acting to process these values with respect to the amplitude contour of individual tones, the relative loudness of different tones in a succession thereof, changes in the duration of the tones and other deviations from the nominal values which together constitute the microstructure of the music notated by the score. The system performs the specified tones in the score as modified by the microstructure, thereby imparting expressivity to the music that is lacking in the absence of the microstructure. The microstructure may include changes in pitch or vibrato.

OUTLINE OF DRAWINGS

For a better understanding of the invention as well as other objects and further features thereof, reference is made to the following detailed description to be read in conjunction with the accompanying drawings, wherein.

Figure 10:
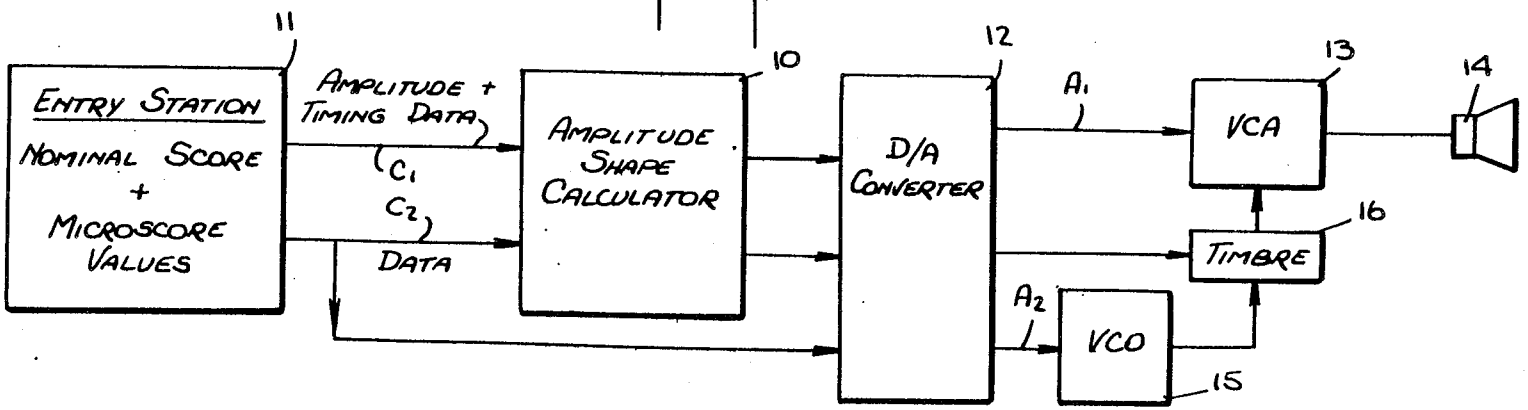
Figure 9:
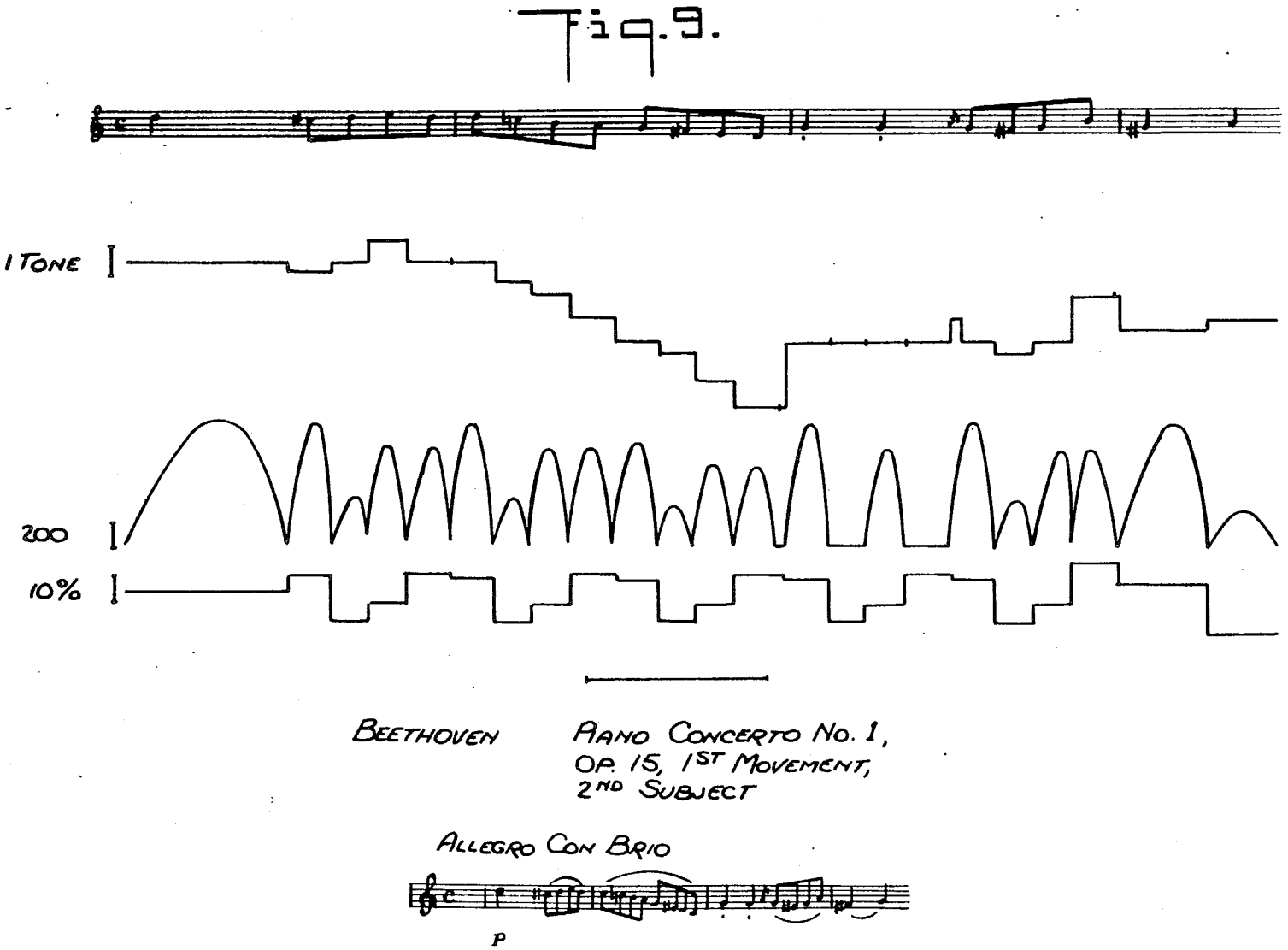

FIG. 8 similarly illustrates the notes of a Chopin theme;

FIG. 9 similarly illustrates the notes of a Beethoven theme;

FIG. 10 is a block diagram of a computerized system in accordance with the invention which is operable in the manual mode;

FIG. 11 is a graph illustrating how an amplitude shaped tone is obtained from a succession of digital values yielded by the calculator included in the system;

FIG. 12 shows both a sinusoidal wave and a differentiated square wave which, when combined, produce a non-sinusoidal wave rich in harmonics; and FIG. 13 illustrates in block form a portion of a system operating in the automatic mode.

DESCRIPTION OF INVENTION

Microstructure and Expressiveness

Consideration will first be given to the extent to which detailed expressiveness is possible without vibrato and timbre, using only sinusoidal tones with individually-shaped amplitude envelopes, representing the notes of the music, with duration modification. Such amplitude modulation appears to be the most basic mode of dynamic expression and thus the understanding of this should precede the analysis of the expressive effects of vibrato, timbre and of timbre variation. It has been found that a significant degree of expressiveness is indeed possible with these very simple means, and that many of the subtlest nuances can be realized.

In doing this, we shall also point out the relationship existing between the amplitude shapes of individual tones and the shape of the melody (i.e. essentic form). We shall show that a simple relationship holds between the shapes of individual tones of a melody and the form of its time course. Its shape within a continuum of upright ⋀ ("assertive") and forward sloping ("plaintive") form ⟋ is seen to be a function of the slope of the essentic form. (Assertive will hereafter be represented by the letter A and plaintive by the letter P) This means in practice that the shape of a tone is strongly and predictably influenced by the pitch of the next tone and by the time when it occurs. The shape of individual tones has a musically predictive function contributing to continuity, and thus, we may say, to musical logic.

We shall also demonstrate how the individual pulse characteristics of a number of composers, in particular Mozart, Beethoven and Schubert, systematically modulate the pattern of tones both in amplitude and temporally, in characteristic ways which will be precisely given. In the course of these considerations we shall also outline how certain microstructure functions, involving durations, silences, and amplitude shapes, relate to various aspects of phrase and larger structure.

Beta Function for Calculating Amplitude Shapes

In order to produce convenient shapes for amplitude-modulating individual tones, we have used a mathematical means, briefly called the Beta Function. This term derives from a similar-named function in mathematical statistics. The Beta Function permits us to create a wide variety of shapes with the aid of only two parameters ($P_1$ & $P_2$). It has a considerably wider applicable scope than the use of two exponentials would have, for example.

In electronic generation of musical sounds, it has heretofore been conventional to specify tones using parameters of rise time, decay time, sustain time, release time and final decay, or some subset of these. These parameters, natural to the electronic engineer, do not really have a musical function of like aptness. Amplitude shapes of musical tones often need to be convex rather than concave (or vice versa) in particular portions of their course (e.g., convex in their termination), and hardly ever have sustained plateaux. Moreover, separation of the termination of a tone into a decay and a release is generally the result of the mechanical properties of keyboard instruments and not a musical requirement.

We have found that the varied rounded forms available through the Beta Function allow a simple and time-economical realization of the multitude of nuances of musical tone amplitude forms. Beta Function is defined as:

$$x^{p1}(1-x)^{p2} \text{ for } 0 \leqq x \leqq 1, \qquad \text{Equation 1}$$

and is normalized for a maximum amplitude of 1 by dividing by a constant.

$$N = \frac{p_1^{p1}\, p_2^{p2}}{(p_1 + p_2)^{p1+p2}} \qquad \text{Equation 2}$$

for a particular set of values of $p_1$ and $p_2$.

$p_1$, $p_2$ have values $\geqq 0$.

The resulting shape is multiplied by a parameter G to give the amplitude size of the particular tone. The shape stretches over a number of points determined by the duration of the tone.

By choosing suitable values of $p_1$ and phd 2, a shape may be selected from families of shapes such as the ones shown in FIGS. 1 to 6. Choosing the value 1 for both parameters gives rise to a symmetrical, rounded form, and 0.89 for both parameters produces a form very close to a sine half wave. Smaller values of $p_1$ result in steeper rises; zero being a step function. Larger values than 1 for either $p_1$ or $p_2$ make the curve concave, at the corresponding regions. A combination of zero and 1 results in a sawtooth.

Most commonly used p values for musical tones generally lie within the region of 0.5 to 5, and most frequently in the region of 0.7 to 2. Where required, a second or several more Beta Functions may be added to produce the desired shape--this is seldom necessary, however.

FIGS. 1 to 4 illustrate different families of Beta Function shapes, showing some of the kinds of shapes readily obtained by choosing appropriate $p_1$ and $p_2$ values. In each group of curves, pairs of $p_1$, $p_2$ values are given starting from the leftmost curve. Maximum amplitude is normalized as 1.

Figure 1:
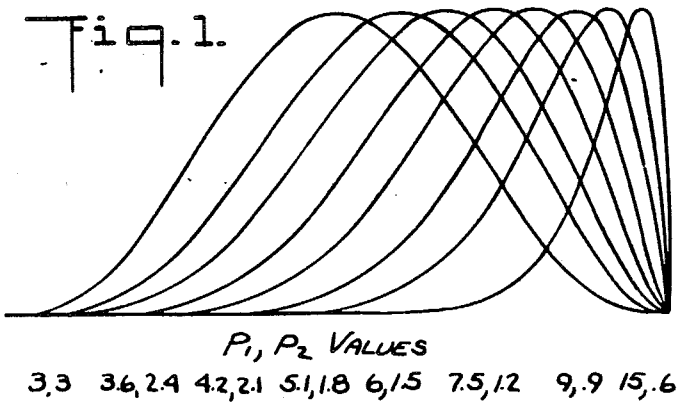
FIG. 1 illustrates a family of curves generated from one set of beta fraction values.
Figure 2:
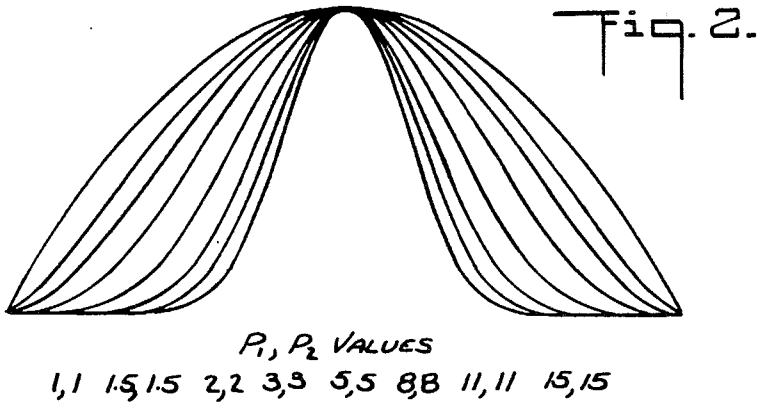
FIG. 2 illustrates a family of curves generated from a second set of beta function values.
Figure 3:
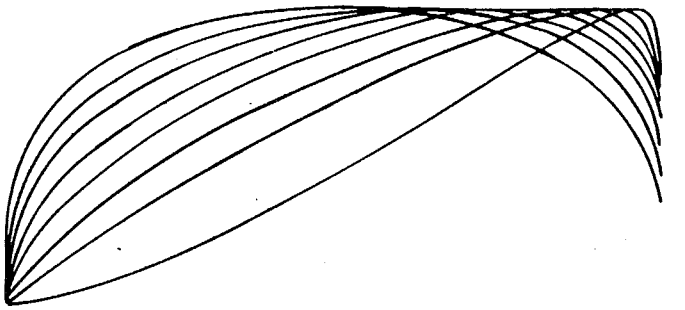
FIG. 3 illustrates a family of curves generated from a third set of beta function values.
Figure 4:
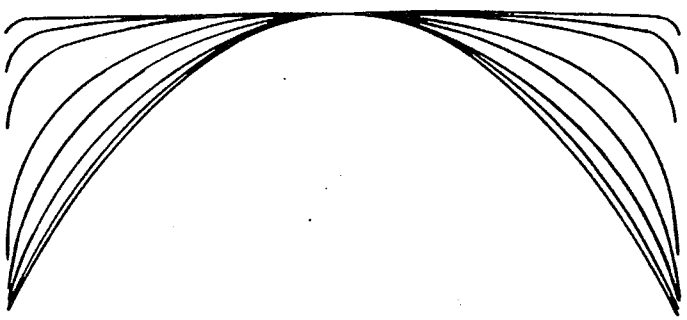
FIG. 4 illustrates a family of curves generated from a fourth set of beta function values.
Figure 6:
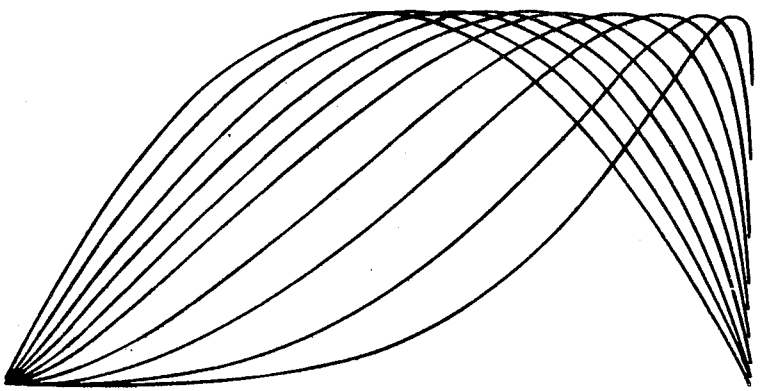
FIG. 6 illustrates a family of curves generated from a sixth set of beta function values.
Figure 5:
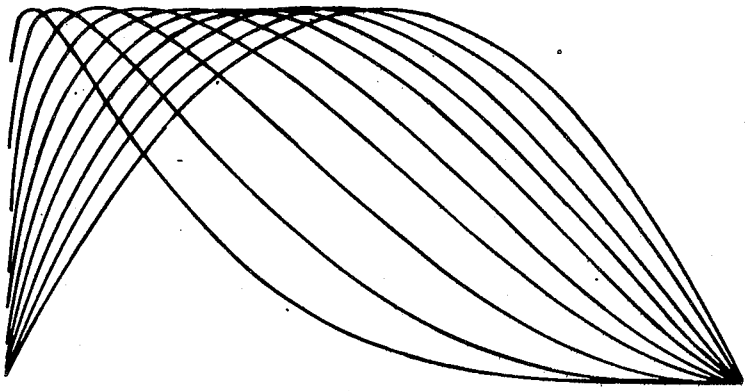
FIG. 5 illustrates a family of curves generated from a fifth set of beta function values.

FIGS. 5 and 6 are Beta Function shapes illustrating degrees of skewness, starting from a symmetrical (1, 1) form, with pairs of p values forming a series as shown. These are types of shapes used for the amplitude of many musical tones (called A [left group] and P [right group] types).

Computer Program for Shaping and Playing Melodies:

The Beta Function is used in a computer program that calculates individual tone shapes. In this program, the amplitude character of a tone is specified by three numbers, respectively denoting the amplitude magnitude G, and parameters $p_1$ and $p_2$. We use a linear scale for the magnitude with a resolution of 1 part in 4096. This in accordance with our findings that such transient sound phenomena may often be better understood by changes in amplitude on a linear rather than logarithmic scale. It also presents a visually more tractable aspect. Silences of various durations in the millisecond and centisecond range can also be readily inserted between tones.

The duration of each tone is specified by the number of points it occupies over which the Beta Function is calculated. The calculation for each tone is done without affecting the duration and number of points of other tones. The temporal resolution of tones is usually better than 1 millisecond. In practice, the amplitude contour may be constituted by a 12 bit DA Converter and modulates a voltage-controlled amplifier (VCA) of linearity better than 0.1% over a dynamic range of 1 to 4096. The frequency of the tones is set by another channel of a DA converter which modulates a voltage-controlled oscillator (VCO).

In practice, the invention may be realized with D to A converters having 8 to 16 bits. One may also use a digitally-controlled VCA and VCO which can, in effect, be integrated within a digital synthesizer, in which event there is no need for a D to A converter to operate the VCA and VCO. In that case, the ultimate sampling rate per channel must be 44 kHz or higher to obtain good quality results.

The FORTRAN IV program was run on a PDP 11-23 compurer. The tempo can be varied over a very wide range. Parameters of any tone can be readily varied and the changed result listened to in a few seconds, typically 2-10 seconds. Any desired portion of the music can be listened to. The maximum length of the piece to be played is only limited by the length of the microscore that can be stored on the disc. In practice, many tens of thousands of tones can be stored.

Manually-Created Microstructure:

Before considering examples of manually-produced microstructures, some general comments may be appropriate.

(i) It may take a musical person a day or two to perfect such a theme by gradually improving the values of the parameters, and repeatedly listening until it is refined to a degree where he no longer is sure what change would be an improvement.

(ii) As one listens repeatedly and changes parameter values for a time, one eventually experiences satiation or lessening of sensitivity to particular aspects and/or the totality of the expression. It appears that one's sensitivities in this regard are dulled with repeated exposure, and need some time to recover, to regain their spontaneous freshness. A few minutes is sometimes sufficient, but after many hours of work, several hours or overnight may be required to revitalize one's listening.

(iii) Working on a theme in this manner in fact sharpens one's hearing and attention to detail in regard to expressive qualities, and can be considered invaluable for that reason alone.

(iv) A further phenomenon occurs as one continues working with a theme in this manner: the theme teaches one its own nature. As one repeatedly interacts, many new aspects, relationships and meanings become clear. One becomes more and more involved with the theme, and it gains more vitality and clarity in one's mind. The goal becomes clearer; yet its form also develops as one works towards it. The process becomes self-refining, a systematic interaction with a stable limit; assymptotic and not seemingly finite, but stable. When one finally reaches the point of not being able to improve it any further, one feels this is not because it could not be improved, but rather that the required changes are so subtle, that greater understanding than can be summoned at the time for A-B comparison would be required in order to continue. But still, there is joy and satisfaction in having created something vital, particularly on hearing it freshly at a later time.

This method of sculpturing tones and melodies allows a musical artist, then, to perfect the expression in much the same manner as a painter or a sculptor can, working with a painting for long periods of time, gradually perfecting the forms so that they correspond to his inner vision, a vision which itself becomes more perfect as the interaction grows. At what stage to say "it is enough" depends on a higher level of integration where another vision and its realization interact in a like manner.

It is also in many ways similar to the process of practicing for a musical performance, in the course of which the artist, enamoured with the piece, refines his performance and understanding through repeated reciprocal interaction-feedforward and feedback.

Resolution of Parameter Values:

Sensitivity in discriminating different shapes of tones is typically of the order of 0.01–0.02 in the p values in the range of 0.5 to 2 (most commonly used). For larger values it is correspondingly greater. The limen of discrimination of the magnitude of amplitude peaks within a melody is of the order of 2% or about ¼dB. This means that the ear is more sensitive to the shape than to peak amplitude. For example, a difference in shape resulting in 2% deviation of critical portions of the shape (referred to peak amplitude) will be considerably more noticeable than a 2% change in overall amplitude Concerning relatively critical portions of the shape of a tone with respect to sensitivity, see Clynes and Walker, supra.

Mozart Quintet

Figure 7:
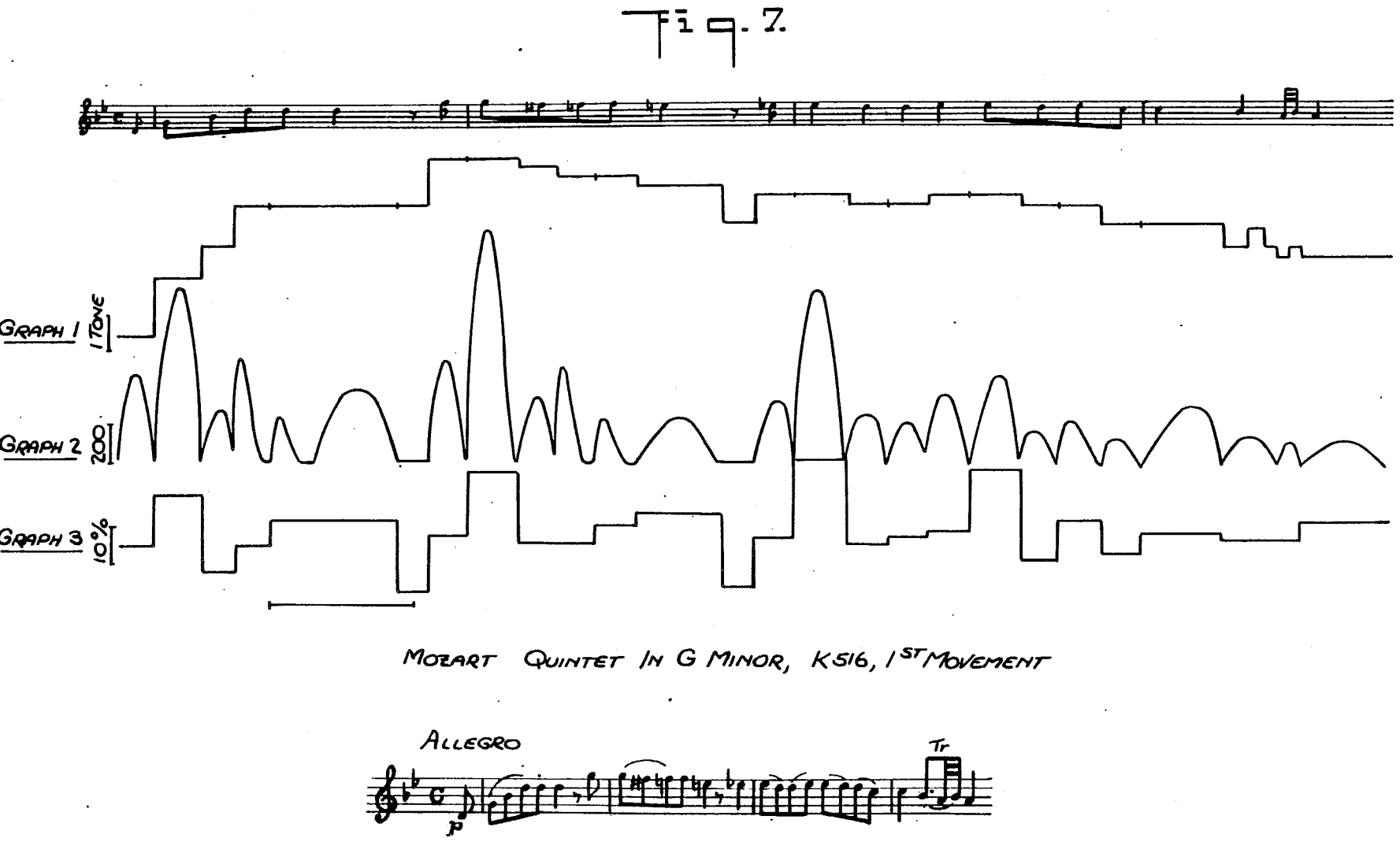
FIG. 7 illustrates the notes of a Mozart theme below which are three graphs representing different microstructural aspects of the theme.

An example of a theme embodied by this method is the first eight bars of the Mozart Quintet in G minor, as shown in FIG. 7.

In this figure, the stave on top shows the notes of the melody.

Graph 1 below this represents the pitch of the sinusoidal tones. Small markers on this graph indicate repetition of the same note and micropauses.

Graph 2 is the amplitude contour (in linear scale from 0 to 4096, the 200 point being thus equivalent to −26 dB referred to as the loudest level; 1000 being played at about 50 dB above threshold normally).

Graph 3 represents the temporal deviations from the nominal values for each tone, in percent, upward deflection being slower. (Micropauses are often included in the representation.) The time marker at the bottom of all figures represents 1 second.

The digital printout prints only every sixth point of the functions--actual resolution is this six times greater than that shown in the illustration.

The table shown below for the Mozart Quintet and similar ones gives a list of all the tones and rests of the computer realization, specifying for each:

1. the duration of the tone, or rest, in points
2. amplitude size
3. amplitude shape ($p_1$, $p_2$)

In some tables, where Beta functions are used to span only part of the duration of the tone, as may occur for staccato tones, the sound duration of staccato tones is given in parenthesis next to the total tone duration. Micropauses are indicated as "P," Rests as "R." When more than one Beta function is used for a tone amplitude, they are listed in vertical sequence for that tone. Metronome mark for the nominal unit used (often a subdivision of a quarter note) is also given.

MICROSCORE
MOZART: QUINTET IN G MINOR, 1ST MOVEMENT
Duration (sec): 8.73
MM (100 pt tomes/min): 230.00

| T# | NOTE | DUR (PTS) | AMPL | P1 | P2 |
|---|---|---|---|---|---|
| 1 | D4 | 100 | 800 | 1.00 | 1.00 |
| 2 | G4 | 123 | 1580 | 1.10 | 0.88 |
| 3 | B4♭ | 88 | 480 | 1.20 | 0.80 |
| 4 | D5 | 100 | 950 | 0.85 | 3.40 |
| 5 | D5 | 112 | 430 | 1.20 | 4.60 |
| 6 | D5 | 223 | 660 | 0.96 | 0.83 |
| 7 | R | 80 | 0 | 0.00 | 0.00 |
| 8 | G5 | 105 | 920 | 1.10 | 1.85 |
| 9 | G5 | 133 | 2100 | 1.15 | 1.70 |
| 10 | F5# | 102 | 600 | 0.97 | 0.80 |
| 11 | F5 | 101 | 850 | 0.80 | 3.20 |
| 12 | F5 | 110 | 400 | 1.00 | 3.60 |
| 13 | E5 | 231 | 380 | 1.45 | 1.40 |
| 14 | R | 83 | 0 | 0.00 | 0.00 |
| 15 | E5♭ | 105 | 580 | 1.20 | 0.65 |
| 16 | E5♭ | 139 | 1550 | 1.28 | 1.65 |
| 17 | D5 | 103 | 430 | 0.85 | 1.00 |
| 18 | D5 | 105 | 380 | 0.85 | 0.90 |
| 19 | E5♭ | 108 | 620 | 0.80 | 1.10 |
| 20 | E5♭ | 135 | 800 | 1.80 | 1.20 |
| 21 | D5 | 95 | 200 | 0.80 | 1.30 |
| 22 | D5 | 113 | 400 | 0.85 | 1.90 |
| 23 | C5 | 98 | 240 | 0.80 | 1.80 |
| 24 | C5 | 215 | 530 | 1.55 | 0.90 |
| 25 | B4♭, C, B♭ | 62, 40, 38 | 245 | 0.83 | 0.80 |
| 26 | B4, B4♭ | 31, 39 | 210 | 0.80 | 0.70 |
| 27 | B4 | 227 | 235 | 1.80 | 1.20 |

The chosen unit of time in the melody (in this case, an eighth note) is assigned 100 points duration nominally, so that a quarter note becomes 200 points nominally, a half note 400 points, and so forth. The actual duration of each tone is modified from these so that a particular eighth tone may have a duration of 96, say, a half tone 220; and so on, depending on its position and expressive requirements.

In this example, all parameters 4 for each tone: duration, peak amplitude, $p_1$ and $p_2$) were chosen by trial and error; that is, by repeated listening and gradually improving the values as dictated by "the ear."

The program allows us to play any portion or the entire theme, and will repeat as many times as desired (with a short pause between repetitions). The metronome mark entered (i.e 230 refers to the nominal chosen unit of duration (in the present example, 100 points for an eighth note). If an actual tone has more or fewer number of points than 100, it will have a correspondingly different duration. Minute tempo variations within the theme arise from the differences from nominal values in the number of points for each of the tones. In this example, we may note the following:

1. Amplitude Relationship within a Four-tone Group (One Pulse)

The amplitude relationship between the four eighth notes of the first bar shows that the second and fourth tones are much smaller, the fourth one being a little less than the second. The third tone is considerably larger in amplitude than the second and fourth but less than the first. A similar pattern is repeated in the third bar, but the accentuation of the first tone is even greater. Throughout the theme, the first tone of each bar is considerably larger in amplitude.

2. Peak Amplitudes Outline Essentic Form

The peak amplitudes form a descending curve from bar 3 to bar 4. The form of this descending curve combines with the frequency contour to produce an essentic form related to grief (this form may well be considered to be a mixed emotion: predominantly sad, with aspects of loneliness, anxiety, and perhaps regret). Bars 1 and 2 provide similar forms of diminishing amplitude, but in bar 1 combined with rising frequency. Pain and sadness are implicit in bar 2. Bar 1 suggests a resigned view, accepting fate, without the quality of hope; "this is how it is; there is nothing that can be done about it." The combined effect is a combination of grief with a stoical, strong acceptance of what is; without defiance or rebellion.

3. Individual Tone Shapes

The shapes of each individual tone are governed by their place in the melodic context. The shorter tones may seem similar in shape on the graph, but in fact they are varied, as can be seen from the p values in Table 3. (Small changes in the p values noticeably affect the quality of the sound.) In the longer tones, such as the fifth tone of bars 1 and 2, first and fifth tones of bar 4, the shape of the termination of the tone is as important as its rise, for appropriate expression. For the shorter tones, the termination phase of the tone relates to the degree of legato that is achieved. Smaller p values result in greater legato. It is not generally necessary to include a DC component to maintain a legato between successive tones. The momentary drop in amplitude between tones shaped by the Beta Function is not perceived by the ear if it is quite short, as is the case for appropriately low p values. Staccato tones are produced in the first few examples by choosing appropriate Beta Functions with high $p_2$ values.

4. Duration Deviations

We may note systematic time deviations from the given note values. First notes in each bar are lengthened, the second shortened. Hardly any tones correspond in duration to the actual note value. Some tones are lengthened by as much a 39% (first tone bar 3). Specially lengthened are first notes of beats 5, 9, that correspond to accentuated dissonant tones, which like suspensions are resolved in the following, second tone of the bar. Such prolongations induce a lamenting quality in the expression.

Further Observations (a) When working with such a theme, one notices fairly quickly that when one changes the amplitude, or duration, of one note, it affects the balance of all notes: that is, the theme is an organic entity. Increasing the loudness of the fifth tone of bar 3, for example, even by only, say, 5%, or one dB, will affect its relationship with first tones of bars 3 and 4. Also, it affects its prominence compared to its adjacent tones, the sixth tone of bar 3 and the fourth tone of bar 3. But further, the altered amplitude contour now constituted by the peaks of the first and fifth tones of bar 3, and the first tone of bar 4 affects how bars 1 to 2 balance with bars 3 to 4.

Similar organic behavior is evident in changing the duration of a tone. Additionally, changing the duration of a tone also affects its relative emphasis. For example, lengthening the upbeat duration will tend to give greater prominence and energy to the following main beat, which then in turn will affect its relation to the other main beats.

The appropriate way to realize the trill, in bar 4, seemed to be to group the trill in terms of 3 and 2 notes (the latter being its termination), each group under a single amplitude contour.

(c) When a phrase is repeated such as in bar 3, the amplitude relationships may be similar, but never the same. Whether they tend to be augmented or diminished in successive repetitions depends on the specific piece, the structural design, and the nature of the composer. In the present theme, the second presentation is less emphatic than the first.

Chopin Ballade

As illustrated in FIG. 8, the opening theme of Chopin's Ballade Number 3 in A flat shows how a melody written for piano, an instrument of limited ability to vary amplitude shapes, can be expressed by varying amplitude shapes according to its character and not in violation of it. In this example, amplitude tone shapes are realized that are implicit in the melody, and are heard inwardly even when they are not actually produced. One thinks this melody with these shapes. Notable in this example is the strong rubato in the second part of the first bar. This quickening reaches its maximum extent on the fourth eighth note and is counterweighed by a slowing down in much of the second bar. The microscore for this Chopin piece is as follows:

CHOPIN: BALLADE NO 3 IN A FLAT, OP 47
Duration (sec): 5.81
MM (100 pt tones/min): 145.00

| T# | NOTE | DUR (PTS) | AMPL | P1 | P2 |
|---|---|---|---|---|---|
| 1 | E4♭ | 224 | 840 | 0.80 | 0.73 |

-continued

CHOPIN: BALLADE NO 3 IN A FLAT, OP 47
Duration (sec): 5.81
MM (100 pt tones/min): 145.00

| T# | NOTE | DUR (PTS) | AMPL | P1 | P2 |
|---|---|---|---|---|---|
| 2 | F4 | 180 | 800 | 1.20 | 0.67 |
| 3 | G4 | 95 | 800 | 1.00 | 1.50 |
| 4 | A4♭ | 80 | 1150 | 1.00 | 0.80 |
| 5 | B4♭ | 98 | 1680 | 1.00 | 0.90 |
| 6 | C5 | 276 | 2170 | 1.70 | 2.53 |
| P | — | 9 | 0 | 0.00 | 0.00 |
| 7 | F5 | 151 | 810 | 0.95 | 2.36 |
| 8 | E5♭ | 340 | 660 | 0.85 | 1.55 |

Beethoven Piano Concerto

FIG. 9 illustrates the first movement, second subject of the Beethoven piano concerto no. 1. The microscore for this piece which illustrates the automatic mode of operation, using both pulse matrix and automatic amplitude and shape calculations ($P_1$ & $P_2$ values) is as follows:

BEETHOVEN: PIANO CONCERTO NO 1 1ST MOVT
Duration (sec): 6.44
MM (100 pt tones/min): 261.00
Base P1, P2: 1.18 0.82

| T# | NOTE | DUR (PTS) | AMPL | P1 | P2 |
|---|---|---|---|---|---|
| 1 | D5 | 400 | 1000 | 1.16 | 0.83 |
| 2 | C5# | 107 | 1000 | 1.30 | 0.75 |
| 3 | D5 | 89 | 399 | 1.46 | 0.66 |
| 4 | E5 | 96 | 799 | 0.96 | 1.00 |
| 5 | D5 | 108 | 799 | 1.18 | 0.82 |
| 6 | D5 | 107 | 1000 | 0.98 | 0.99 |
| 7 | C5 | 89 | 899 | 1.06 | 0.91 |
| 8 | B4 | 96 | 799 | 0.96 | 1.00 |
| 9 | A4 | 108 | 799 | 0.98 | 0.99 |
| 10 | G4 | 107 | 850 | 1.07 | 0.90 |
| 11 | F4# | 89 | 340 | 0.95 | 1.01 |
| 12 | E4 | 96 | 680 | 0.96 | 1.00 |
| 13 | D4 | 108(99) | 650 | 1.18 | 0.82 |
| P | — | 17 | 0 | 0.00 | 0.00 |
| 14 | G4 | 107 | 1000 | 1.18 | 0.82 |
| 15 | R | 89 | 0 | 0.00 | 0.00 |
| 16 | G4 | 86 | 800 | 1.18 | 0.82 |
| 17 | R | 108 | 0 | 0.00 | 0.00 |
| 18 | A4, G4 | 24,83 | 1000 | 1.07 | 0.90 |
| 19 | F4# | 89 | 400 | 1.31 | 0.74 |
| 20 | G4 | 96 | 800 | 1.77 | 0.55 |
| 21 | B4 | 107 | 800 | 0.89 | 1.09 |
| P | — | 7 | 0 | 0.00 | 0.00 |
| 22 | G4# | 210 | 1000 | 1.24 | 0.78 |
| 23 | A4 | 170 | 280 | 1.00 | 1.00 |

1 pulse considered to be ¼ half note

Automatic Linking of Amplitude Shapes of Individual Tones to Melodic Form

Having observed and worked with a large number of examples in the manner illustrated in the previous section in connection with a Mozart Quintet and considered the interaction between amplitude shapes of individual tones and the music, we were enabled to posit a certain relationship between the amplitude shapes and the melodic course of the music.

A and P Classes of Amplitude Shapes

Let us consider these shapes to belong to a continuum between two classes ⌃ and ⌒ intermediate shapes between the two extremes. We may conveniently call these classes (A) assertive and (P) plaintive or pleading, respectively—without wishing at all thereby to tie the musical expression to such categories, of course.)

We can then consider an actual tone shape as placed somewhere along this continuum—and consider the nature of the influence that displaces it from a neutral position (the base shape) to the place on this continuum where it needs to be.

We can describe forms along this continuum by pairs of p values, starting from a base shape (say 1,1) such that as the values of $p_1$ increase those of $p_2$ decrease in proportion, and vice versa. Thus, say, for example (0.9, 1.11) , (0.8, 1.25), (0.7, 1.42) etc. will give a series of shapes shifting gradually towards class (A) which has a realtively sharp rise time). The inverse series (1.11, 0.9), 1.25, 0.8), 1.42, 0.7) etc. will tend more and more towards class (P) (of gradual rise time).

We then can consider the influence which causes the shift to be the slope of the essentic form, as measured by the slope of the pitch contour.

More particularly, the deviation from a base shape for a particular tone is seen to be a function of the slope of the pitch contour (essentic form) at that tone: both pitch and duration determine the deviation in such a way that:

(a) Downward (−ve) steps in pitch deviate the shape towards A, upward steps toward P, in proportion to the number of semitones between the tone and the next tone.

(b) Deviations are affected by the duration of the tone so that the longer the tone, the smaller the deviation (since the slope is correspondingly smaller).

Further, in practice, the slope is measured from the beginning of the tone considered to the following tone. In measuring the slope between the tone and the next tone, rather than the previous tone, the amplitude shape acquires a predictive function. The first derivative of a function has a predictive property (lead in phase). The amplitude shape associated with a particular slope leads us to expect a melodic step in accordance with it. The movement of the melodic line is thus prepared.

This appears to match well with its actual function in music, relating the present tone to what is to follow, and may be considered to be in accordance with musical logic. It gives a sense of continuity both musically and in terms of feeling.

Experience shows that the proportionality constant needs to be an approximately 10% change in the p values per semitone, for tones of 250 msec duration. The shift is, of course, to be expected to be linear only over a limited range; a degree of nonlinearity for both the duration and pitch factors existing over a broader range.

In order to see how the duration factor and the pitch factor may obey different power laws, the equation is put into the form:

$$\left.\begin{aligned} p_1 &= p_{1(i)}e^{bsexp(-aT)} \\ p_2 &= p_{2(i)}e^{-bsexp(-aT)} \end{aligned}\right\} \qquad \text{Equation 3}$$

where s=number of semitones to next tone b=const. of $p_{1,2}$ by frequency a=const. of modulation $p_{1,2}$ by duration T=duration of tone in milliseconds $P1(i)'$ $P2(i)$=base (initial values of $p_1$ and $p_2$ Experience has shown that preferred values are in the region of $a=0.00269$ $b=0.20$ for such music.

It is to be understood that a simplified or linear equation may be substituted for equation (3) having approximately the same behavior within the range considered.

Choice of Base Values

There remains to consider the choice of the base form, which we have nominally put at 1,1.

In music of different composers, and of different types, it would seem that certain preferred base values apply. Values in the vicinity of (1.2, 0.8) appear as an appropriate choice for much of Beethoven—giving a greater legato and more gradual attack. For Mozart, base values around (0.9, 1.1) give a more rapid decaying sound, and a somewhat sharper attack. For Schubert, base values in the vicinity of (1.15, 0.9) are seen to be appropriate.

These values are influenced by the type of instrumental sound that the style of the composer appears to require, and may also be linked to historical consideration of the instruments in use at the time. They may also be related to how the inner pulse affects the microstructure, which we will consider in the next section.

Equation 3 relates to the use of Beta Functions to obtain the desired shift in amplitude shape. In practice, when one chooses not to employ Beta Functions, the amplitude shape may be modified as a function of the slope of melodic form using traditional expedients for individually shaping the component tones of a melody; that is, such expedients as attack, decay, sustain and release, which are appropriately varied.

Other Implications

Silence before Downward Leaps

The rule implies that within a "legato" melody for a tone of given duration, the larger the upward leap in pitch to the tone that follows, the more should the tone have a (P) form, and the larger the downward leap, the more marked the (A) form. In the case of a downward leap in moderate and fast tempo this can (depending on the size of the leap and the duration of the tone starting the leap) in a momentary silence—microsilence (due to the tail of the (A) form) before the low tone. This is felt as appropriate in larger downward leaps. In upward leaps, silence will tend to occur before the tone starting the leap.

Expressiveness of Scales

Also implied is that tones of scales have somewhat more (P) shape going up, and going down more (A) (the exact deviation depending on the tempo as given by equation (3)). In fact, scales become considerably more musical when this rule is appropriately observed.

(We may also relate the amplitude shape deviations to the type of gestures with which one would conduct the music; often a downward gesture goes with greater (A)—assertive; an upward gesture with more (P)—plaintive, pleading).

Limitations of the Equation

By the nature of the rule, it cannot predict the amplitude shape of the last tone of a melody (since it measures slope to the next note)—this must be entered manually. (It is possible, however, that a rule referring to last notes of phrases may be formulated which would also take into account aspects of larger structure.) Further, it does not apply to tones which require more than one Beta function.

The basic thought behind this formulation is: if we can consider the available shapes to lie along a continuum between (A) and (P) forms, then the slope of the essentic form at that tone determines where in that continuum a particular tone lies. The particular merit of this formulation may be seen in that it harmoniously integrates the behavior of single tones to that of the larger whole, for different kinds of music. In this, it seems to show a surprising elegance and power—and musicality.

The Composer's Specific Pulse Expressed in Microstructure

In the previous section, we have been how the amplitude shape of individual tones can be derived from the form of the melody. We can now proceed and ask, how much of the remaining unaccounted microstructure can be attributed to the function of the inner pulse? It seems an unexpectedly large amount.

The inner pulse of a given composer is not the same as the rhythm or meter of a piece; it is found in slow movements, in fast movements; in duple time, in triple time, or compound time. The tempo of the pulse has generally been considered to be in the range of 50–80 per minute. In slow movements, one pulse may correspond to an eighth note, even a sixteenth in a very slow movement; in a fast movement a half note; and in a moderate movement a quarter note.

The inner pulse as a specific signature of a composer became established in Western music around the middle of the eighteenth century and continued until the advent of music in whose rhythmic motion there no longer was interfused an intimate revelation of the personality of the composer. In the music of Mozart, Haydn, Beethoven, Schubert, Schumann, Chopin, Brahms, for example, we find a clear and unique personal pulse which the composer has impregnated successfully into his music (the knowledge of which we ultimately acquire from the score). Indeed, because of the time course of the inner pulse, (0.7–1.2 sec. approx. per cycle), the matrix of its wave form is most prominently expressed in microstructure.

In considering the nature of the beat, and of the inner pulse, the property of the nervous system called Time Form Printing is very relevant. This function enables the human organism to decide on a particular form of movement to be repeated, and the rate, and then to repeat the movement at that rate without further attention—until a separate decision is made to stop or to alter the form or the rate of the movement. Once conceived as a repetitive movement and initiated, the movement will continue in "automatic" fashion until stopped. This process takes place mentally when thinking the beat, and the inner pulse.

In practice, this means that once initiated, the inner pulse can carry through the musical piece without need for further specific initiation of form, although the rate will be caused to vary to a degree. Small pauses can momentarily suspend the pulse, and act as punctuation, as it were, in the musical phrasing.

In any composition, certain parts of the score embody the pulse more clearly and obviously than others. However, through Time Form Printing, the pulse will tend to carry through all parts, if it has been well initiated at the beginning of the piece. Scale passages, for example, can become characteristic of the composer through the pulse: the same scale passage can be played with a Mozartian pulse or with a Beethovenian pulse, for example, and will sound appropriate correspondingly. (This does in fact happen in satisfying performances.) Thus "neutral" passages acquire from the pulse the characteristic "flavor" of the composer. This, of course, is precisely the province of microstructure, and we shall show how this occurs.

By experimenting with such neutral structures, and combining the results with knowledge of the inner pulse forms as expressed through touch, we can arrive empirically at an answer to the question: What does the inner pulse do to the specific tones in a piece of music?

Concerning the Derivation of Pulse Microstructure Values

The following considerations have aided the derivation of these values.

Characteristics of the pulse matrix may be in part connected to the kinesthetic "feel" of the pulse, observed in recording it sentographically. We have seen that different degrees of inertia, damping, can be experienced for pulses of various composers, and for some pulses different kinds of tensions occurring at specific phases.

These show up indirectly in the recorded sentographic form; but appear to be significant clues to the deviations in amplitude and duration that constitute the matrix. Different degrees of inertia, or sluggishness, are brought about by different modes of tensions by agonist and antagonist muscle groups (as a result of which greater or lesser massiveness is displayed by the arm—e.g., more of the upperarm mass is involved). This massiveness, a mental program, translates to the degree of flexibility of modulation within a pulse. The Beethoven pulse has high inertia, the Mozart pulse low inertia. Accordingly, we would expect to see much greater differences between the amplitude of component tones for Mozart than for Beethoven. Indeed, there is a relative effortlessness in changing the loudness level in Mozart within a pulse, that is not present in Beethoven.

The massiveness has an influence also on the duration deviations, since each pulse cycle contains an initiating point at a particular phrase (near the time of the upbeat). The deviation values can also be looked at in the light of rhythm studies that relate the energy of a beat to the duration and amplitude of the upbeat, in relation to a given downbeat. High inertia would accordingly tend to be accompanied by a longer duration upbeat.

Pulse Matrix of Mozart, Beethoven and Schubert

A two-fold effect may be observed: The inner pulse affects

1. Relative amplitude sizes of its component tones.
2. Duration deviations of its component tones. Both 1 and 2 must occur. Either alone is insufficient. Accordingly, the influence of a composer's pulse is stated for a particular meter by a matrix that specifies (1) amplitude ratio, (2)duration deviations.

The following matrices specify the influence of the inner pulse for Mozart, Beethoven and Schubert, respectively, the 4/4/ meter. For each tone, two numbers are given. One specifies the amplitude size ratio, referred to the first tone as 1. The other gives the duration referred to as 100 as a mean duration for the 4 components.

| | Tone No. | | | | |
|---|---|---|---|---|---|
| | 1 | 2 | 3 | 4 | |
| Amp. Ratio | 1 | .39 | .83 | .81 | Beethoven |
| | | −7.8 db | −1.8 db | −2.0 db | |
| Duration | 106 | 89 | 96 | 111 | |
| Amp. Ratio | 1 | .21 | .51 | .23 | Mozart |
| | | −14.4 db | −6.6 db | −13.5 db | |
| Duration | 105 | 95 | 105 | 95 | |
| Amp. Ratio | 1 | .65 | .40 | .75 | Schubert |
| | | −3.1 db | −7.7 db | −1.9 db | |
| Duration | 98 | 115 | 99 | 91 | |

Salient Features of the Pulse Matrices

The Mozart Pulse

Large amplitude difference between first tone and the others—archness in articulation, second tone very slightly softer than the fourth tone, the third tone having a subsidiary accent, subdividing the four tones.

Duration deviations are rather symmetrical, first and third tones moderately longer.

The Beethoven Pulse

Amplitude ratios generally more even, fourth tone not softer than third. Second considerably softer than first. Durations: First tone considerably extended Fourth tone considerably extended.

The extended duration of the fourth tone combined with its relatively high amplitude is a cardinal feature of the Beethoven pulse. The third tone is not extended in duration, and is more nearly equal to the first tone in amplitude than for Mozart. A more even, less arched articulation, with a special aspect to the fourth tone. (A resistance is displayed against "excessive" amplitude modulation—experienced often as a kind of "ethical restraint.") First and second tone taken together are contracted compared with the third and fourth tone together.

The Schubert Pulse

Low amplitude of the third tone—no subdivision; higher amplitude and short duration of the fourth tone. No duration extension of the first tone (or third tone) but a considerably extended duration of the second tone. Third and fourth tones, taken together, are contracted compared with first and second tones together.

The unusually extended duration, without accent, of the second tone of the Schubert pulse can be linked to the following:

1. The special tension that occurs in the corresponding part of the Schubert pulse, a pulling upward, uniquely characteristic of the Schubert pulse. Its initial downward phase acts on low inertia. During the course of a rebound, however, a tension is added, increasing the resistance and slowing down what otherwise would be a carefree bounce, into an entirely different character, an impression of being pulled upwards.
2. It can be seen in the scores of Schubert's music that there is a predilection for special treatment melodically, or in other ways, of the weak tone following the first tone of the bar. In performance and in thought, these deviations are not experienced as unevenness, but appear as an appropriate flow.

Pulse matrix values for triple meters are as follows for the three composers illustrated:

| Duration | Amplitude Ratio |
|---|---|
| BEETHOVEN | |
| 105 | 1 |
| 88 | .46 |
| 107 | .75 |
| MOZART | |
| 106 | 1 |
| 97 | .33 |
| 97 | .41 |
| SCHUBERT | |
| 97 | 1 |
| 106 | .55 |
| 98.5 | .72 |

Values for duple meter are derived simply from the quadruple values by adding the duration of tones 1 and 2, and of tones 3 and 4, respectively, to obtain the duration proportions, and keeping the amplitude values for tones 1 and 3, which now become 1 and 2.

Thus the matrix values for duple meter are:

| Duration | Amplitude Ratio |
|---|---|
| BEETHOVEN | |
| 97.5 | 1 |
| 103.0 | .83 |
| MOZART | |
| 100 | 1 |
| 100 | .51 |
| SCHUBERT | |
| 106 | 1 |
| 94.5 | .40 |

Pulse matrices for compound meters can be derived from the above as follows:

The two matrices are combined so that $$\text{amplitude ratio } A_c(i,j) = A_1(i)A_2(j)$$

$$\text{duration factors } D_c(i,j) = \frac{D_1(i)\,D_2(j)}{100}$$

where $A_c(i,j)$ is the compound pulse amplitude $D_c(i,j)$ is the compound pulse duration $A_1(i)$, $A_2(j)$ are the simple pulse amplitudes and $D_1(i)$, $D_2(j)$ are the simple pulse durations respectively for the $i^{th}$ and $j^{th}$ tone of the simple pulses.

To allow for different degrees of hierarchical dependence attenuation factors are introduced that allow the effectiveness of the subordinate pulse structure to be de-emphasised or emphasised, with the parameters n and m, so that when n=1 and m=1, a full hierarchical effect is obtained, and for smaller values the duration and/or amplitude effects of the subordinate pulse structure are relatively more attenuated. Thus $$\text{amplitude ratio } A_c(i,j) = A_1(i)A_2(j)^n$$

$$\text{duration factors } D_c(i,j) = \frac{D_1(i)D_2(j)}{100} - (1-m)\left[\frac{D_1(i)D_2(j)}{100} - D_1(i)\right]$$

values ot n and m in the range of 0.7 to 0.8 are found to be often appropriate.

For example, the 6/8 pulse for Beethoven is

| | |
|---|---|
| for n = 1, m = 1 | |
| 102 | 1 |
| 86 | .46 |
| 104 | .75 |
| 109 | .83 |
| 91 | .38 |
| 111 | .62 |
| for n = .8, m = .7 | |
| 101 | 1 |
| 88 | .58 |
| 103 | .82 |
| 108 | .83 |
| 94 | .48 |
| 109 | .68 |

The effect is that each group of 3 tones constitutes a small 3-pulse, and the two groups of 3 tones form a 2-pulse.

Applying the Pulse to a Melody Having Various Note Values

When a melody has a combination of notes of different values, as is generally the case (some larger and some smaller than the component values), the following appears to apply:

1. Duration deviations are proportioned according to the component tones of the pulses; e.g., a dotted quarter has the duration deviation of one tone plus half that of the next.
2. The amplitude is taken as that prevalent at the beginning of the tone; i.e., is not averaged; e.g., the dotted quarter has the same amplitude as the quarter would have had without the dot.

While it appears that the range of 50–80 per minute is an approximately useful guideline in applying the pulse, some pieces may present alternate possibilities of a larger or smaller frame for the pulse.

An example of automatic operation of the system using a pulse matrix and using automatic calculations of amplitude shape (p values) is given in FIG. 9.

In general, it should be emphasized that the pulse and its effects in microstructure as described herein is in no way to be considered a binding Procrustes bed, but rather as a level from where fine artistic realization of the music can be more readily attempted, taking into account the individual concept of the piece, and personal interpretive preferences.

Additional Expressive Functions And Properties Considered

Further properties of melodic relationships relevant to manual and computer realizations are:

1. Microstructural

In working with the various examples manually, we may readily note that:

(a) A tone of smaller amplitude following a larger amplitude tone will sound more legato than in the reverse order, for given amplitude shapes (p values).

(b) A tone will sound softer after a tone of greater amplitude than before it ( a masking effect, the degree depends on the tempo).

(c) Micropauses often need to be inserted between phrases, and longer Luftpauses between major sections. They are appropriate for all composers. The placement of these is important, and not automatic. These pauses tend to be placed at the end of pulses (before the next upbeat tone, where there is one). They also occur immediately before a subito piano.

At times the required pauses are actually provided for by the p values, as calculated by the rule given, by means of the tail of the amplitude shape—this means that in such a place, the composer's indication of phrasing indicates the amplitude shape required by the music. Also, they may be appropriate between separate bowing marks (as distinguished from phrasing signs—an often difficult distinction), but not always.

2. Structural (a) Pitch Crescendo. It can be noted that there is a general tendency within a melody to increased loudness with higher pitch. This tendency is not found to the same degree, however, for different music and different composers. For Beethoven, it is appropriate to keep the amplitudes in terms of voltage similar. This insures a small degree of crescendo, since a given voltage amplitude is perceived as louder with increasing pitch. For Mozart, however, this crescendo tends to be greater—approximately an additional 4 db/octave. For Schubert, it can be even more than 6 db/octave.

If the same melodic crescendo is applied to Beethoven, the effect tends to sound exaggerated. There is a resistance to such crescendo in Beethoven, a restraint that (as in the modern modulation of tone amplitude heights by the Beethoven pulse) appears to translate into the strength of an ethical constraint.

(b) Alternation of "heavy" and "light" bars. This is a general structural property (not explicit in the score) which can be produced on the computer by scaling down the "light" bars. For Mozart, a suitable amplitude proportion may be 0.72, and bars often (but of course not always) alternate as Heavy-Light, Heavy-Light. This adds considerably to the sense of musical balance and logic, where appropriate; it presents larger units to the mind, allowing a greater overview.

In Beethoven, other patterns tend to dominate and often special dramatic devices, such as crescendo and subito piano. Crescendi and Diminuendi specially noted by the composer in the score have, of course, to be included in the computer realizations.

A Preferred Procedure for Shaping A Melody

We may concisely summarize the steps involved in controlling microstructure for the artistic shaping of a melody. Steps 7 to 9 are not always required. Some of these steps can be combined into single, automatic operations:

1. Enter tones and nominal durations according to score.
2. Choose tempo.
3. Apply pulse matrix for the particular composer, and particular meter (choose length of pulse) (B, M, or S for Beethoven, Mozart and Schubert, respectively).
4. Insert micropauses of appropriate duration at appropriate places (end of phrases and other special points).
5. Choose base $p_1$, $p_2$ values and let the program calculate p. values for amplitude shapes of individual tones.
6. Adjust last tones of phrases by "ear" (both amplitude and p values).
7. Apply pitch cres-dim function as appropriate, and any cres or dim or special accents directed by the score.
8. As required, modify amplitude and/or duration of one or several key tones to shape a particular essentic form.
9. If phrases repeat, subtly change the repetition as desired.

The first tone only of the theme is generally to be lengthened in duration by about 5%, at the beginning of a piece (but not on subsequent reintroductions of the theme).

A few minutes are generally sufficient to carry out these steps. It is, of course, useful to listen to the result after each step is taken. Micropauses $p_1$, $p_2$ base values or other parameters can be adjusted at any time to improve the result, as desired.

The Stability of Pulse Matrices

The pulse matrix values given previously are subject to further refinement. The salient features of the specific pulse matrices hold over a wide range; but their degree of prominence is likely to be influenced to some degree by the tempo (with the range given; 50–80 per minute), and by pitch height of the entire theme (i.e., transposition). These factors may modify the elements within the pulse matrices as a second order effect. Other second order changes in the pulse forms may occur with variables such as variables related to specific pieces and the composer's age.

Relation of Timbre to Microstructure

Timbre is essential for melodic expressiveness when there is more than one melodic line. Several sinusoids tend to coalesce and fuse—distinctness of voice leading and contrast sounds with dynamic proportions of harmonics are required. Secondly, we can now, in the light of the present studies with sinusoids, investigate how timbre variations are of help in improving expressiveness of a single melogic line.

Within each tone it is possible to add timbre (and also vibrato) various dynamic ways to the expressive forms already determined, and to see how such individually shaped time varying functions of timbre for each tone (time-shaped harmonic content—not only in relation to the attack) may augment or interfere with expressiveness. One must take into account the complication that addint timbre (and/or vibrato) can modify the perception of amplitude shapes, in part because the overtones require their own amplitude shaping (not according to the amplitude shapes of the fundamental), as well as for psychophysiologic reasons related to persistence of hearing and dynamic masking.

Summary of Findings

We have found that:

1. Expressiveness and Microstructure can be fruitfully studied with amplitude-modulated sinusoidal sounds. Musical meaning in its subtlety can be largely expressed by this means for single melogic lines.
2. A systematic relation appears to exist between individual amplitude shapes of tones of a melody and its course, so that the shape can be predicted from the slope; and thus is heard to presage the next tone of a melody—forging an organic link, and making it possible for the living qualities inherent in the melodic shape to cast a presence within each tone.
3. In music which incorporates a personal pulse, this is shown to systematically affect both amplitude and duration of component tones in a way characteristic to that personal pulse, as also an individual's signature bears the continuing stamp of his person. The realization of the pulse and its effects is seen to be necessary for the life, power and beauty of such music.

Among the advantages of imparting microstructure to a musical score in a computerized system in accordance with the invention are the following:

1. It can improve one's artistic understanding and output.
2. Far from being "mechanical," it can infuse life and livingness into music.
3. It tends to give us a degree of understanding of the very nature of that livingness, as bound to iconic and unique form.
4. It allows us to use imagination and creative insight from a higher hierarchic point of view, using as units of thought entities that before needed to be specially constructed every time from constituent parts.

The practical applications of a computerized system in accordance with the invention to music education are obvious and therefore need not be detailed. In an age of personal computers, the programs developed therefor can give access to creative interpretation to all so inclined without the need to acquire physical musical skills or manual dexterity.

The invention is also useful to a serious or amateur composer, for it allows the composer to incorporate his own realization of microstructure into the macrostructure of his own composition, and it also allows him to experiment with inner pulse forms. The final product thereby reflects the imagination, feeling and discernment of the individual who shapes a musical composition. The computerized system serves as a tool which assists its user in thinking musically in a manner somewhat analogous to the relationship of an electronic calculator to a mathematical concept.

The Computerized System

Referring now to FIG. 10, there is shown a manually-operated computerized system in accordance with the invention based on the technique disclosed hereinabove for processing the nominal tones of a raw score entered therein to impart an expressive microstructure thereto.

The system includes a beta function calculator 10. In the calculator is entered by way of a computer keyboard or means performing a like function represented by entry station 11, the successive tones of a music score in terms of their nominal pitch and duration values expressed in alpha-numeric terms. Thus the pitch of a given note, which depends on its position on the staff, is represented by an appropriate value, as is the duration of the same note. In practice, an electronic piano keyboard may be used. By depressing a selected key, there is produced an appropriate value for entry into the calculator. In that case, the tone duration will have to be normalized.

Also entered manually into calculator 10 is the desired microscore of each nominal note. By "microscore" is meant digital values representing desired deviations from the nominal values of the note necessary to its processing to impart a microstructure thereto.

Thus the $p_1$ and $p_2$ values required by the beta function to shape the amplitude contour of each note is entered as well as digital values representing changes in the duration of each note and values representing the relative amplitude of successive notes in the score. Also entered are micropauses and whatever other variables are to be processed by the system, such as timbre.

From entry station 11, there are two channels $C_1$ and $C_2$ leading into calculator 10, channel $C_1$ conveying the amplitude and timing data, and channel $C_2$ the pitch and timbre data for each note.

Calculator 10 is programmed to process the data supplied thereto and to yield a series of equi-spaced digital values V during a specified interval, as shown in FIG. 11, that represent the successive amplitude levels in the contoured tone T whose microstructure duration is interval P. In the absence of the microstructure impressed on the nominal tone, its form would be represented by a square wave of constant amplitude and predetermined duration, which depends on whether it is a whole note, a half note or whatever else is notated.

The series of digital values V, which outline the amplitude shape, are applied to a D-to-A converter 12 to yield an analog voltage $A_1$ reflecting the amplitude contour or envelope of the processed note. The digital data derived from entry station 11, which represents the frequency of each note, is also fed to D/A converter 12 to yield an analog voltage $A_2$, reflecting the pitch of the tone to be played.

Analog voltage $A_1$ representing the amplitude contour is applied to a voltage-controlled amplifier 13 (VCA) whose output is applied to a loudspeaker 14. Analog voltage $A_2$ representing the pitch is applied to a voltage-controlled oscillator 15 whose output frequency is in accordance with the pitch of the tone. The sinusoidal output of this oscillator may be applied directly to amplifier 13, in which event the reproduced tone is without a harmonic content but has the desired microstructure impressed thereon. Alternatively, the oscillator output may be applied to the amplifier through a timbre network 16 which changes the sinisoidal wave shape so that the resultant tone is rich in harmonics and therefore has a timbre depending on its harmonic content.

Any known means may be used for introducing a varying harmonic content. One approach is to combine a sinusoidal wave SW, as shown in FIG. 12, with the differentiated form DW of a square wave having the same period, the resultant sharp pulses being adjustably clipped and rectified to provide sharp peaks which, when summed with the sinusoidal wave, produce a nonsinusoidal wave having a desired harmonic content that depends on the adjustment of clipping and rectification. The resultant sum may be further variably rectified to provide preponderantly even or odd harmonics.

With each tone, the timbre is varied through a number of D to A control channels, typically up to 4 channels, each output of which is shaped by beta functions or equivalent means. All of these functions can also be carried out in an entirely digital manner in a digital synthesizer.

It is to be understood that among the means usable for producing a varying harmonic content are additive or subtractive synthesizers, wave shaping and other means, realized either digitally or through analog means.

It is to be understood that while calculator 10 is advantageously operated in accordance the beta function disclosed herein requiring only two parameters ($p_1$ and $p_2$), in order to produce a desired amplitude contour, any known electronic means to effect amplitude shaping in response to applied digital parameters may be used for the same purpose.

In operating a system in accordance with the invention in an automatic mode, all of the digital values with respect to amplitude and duration necessary to impart a microstructure to the nominal note values of the raw musical score entered therein may be stored, as shown in FIG. 13, in a pulse matrix 17 which in one output channel $A_3$ yields the amplitude and timing data required to process each note, and in another output channel $a_4$ yields the necessary pitch data for each note. The digital data from channel $A_3$ is allied to an amplitude-shaped calculator 18, while digital data from channel $A_4$ is applied to a timbre calculator 19.

The amplitude envelope from amplitude shape calculator 18 is applied to a tone generator 20, while tone shape data from timbre calculator 19 is also applied to the tone generator which generates tones having the desired microstructure. In the amplitude-shape calculator, the shaping function related to the melodic and essentic form is calculated as a deviation from a base shape in accordance with Equation 3, as explained previously.

It is to be understood that when two or tones are to be sounded simultaneously, separate channels will be required for each tone and their outputs summed. Tones may also be directed to different loudspeakers to create stereo and spatial sound effects.

While there has been shown and described a preferred embodiment of a computerized system for imparting an expressive microstructure to a musical score in accordance with the invention, it will be appreciated that many changes and modifications may be made therein without, however, departing from the essential spirit thereof. Thus, while the invention has been illustrated as it applies to classical music, the invention is by no means limited to this application, for it is fully applicable to all other forms of music, including popular and ethnic.

It must also be noted that the microstructure elements set forth herein may be used to modulate visual presentations so that by employing video graphics, the shape, brightness and color of visually displayed forms may be variously modified to express visual counterparts to the expressiveness imparted to music by the microstructure. Simultaneous presentations of such sound and visual forms may further enhance their expressive quality.

The visual presentations may assume free or abstract forms which, by reason of the microstructural modulation, become more expressive and appear to move or dance and thereby take on a more animated character. For example, the visual presentation may be in the form of a conductor's baton whose movement is related to a musical score and its microstructure. Human body or facial expressions may be made responsive to microstructural modulations. Such microstructure can also be used to supplement or refine existing dance notation, such as Laban notation.

I claim:

1. A computerized system for imparting an emotionally expressive microstructure to the respective notes in the score of a musical composition constituted by a succession of notes whose notation provides the nominal value for each note in regard to its pitch and duration, said system comprising:

A. a digital calculator;

B. means to enter into said calculator nominal data representing the nominal pitch and duration of each of the successive notes in the musical score to be processed;

C. a matrix having stored therein microstructure data relating to the relative loudness and duration values of a series of notes forming a group representing the inner pulse of a given musical composer;

D. means to enter into said calculator said microstructure data, said calculator including means to process the nominal data entered therein with reference to the microstructure data entered therein to yield in its output with respect to each note in the succession thereof a series of digital values representing loudness and duration changes in accordance with their interrelationship to said inner pulse and to contour the amplitude of each note in accordance with its relationship to the succeeding note; and E. means responsive to said output to generate and audibly reproduce tones representing the notes of said score with said microstructure data impressed thereon to render the reproduced music derived from the score expressive.

2. A system as set forth in claim 1, further including a second calculator into which microstructure data is entered relating to desired timbre variations of each note and means responsive to the output of the second calculator to modify the timbre of the reproduced tones accordingly.

3. A system as set forth in claim 2, wherein the varying timbre is entered into said second calculator by a number of data functions, each of which involves two parameters.

4. A system as set forth in claim 1, wherein the microstructure data entered into the calculator for each note in the score represents the desired amplitude contour thereof by two parameters of a beta function whereby the calculator, on the basis of these parameters, determines the desired contour.

5. A system as set forth in claim 1, wherein timbre is imparted to a tone of a given nominal pitch by means generating a sinusoidal wave of the same frequency as the tone and combining this wave with the clipped peaks of a differentiated square wave having the same period as the sinusoidal wave to provide harmonics thereof.

6. A system as set forth in claim 5, wherein the combined wave is varyingly rectified.

7. A system as set forth in claim 1, wherein said means responsive to said output includes a digital-to-analog converter to convert said series of digital values into a corresponding analog voltage.

8. A system as set forth in claim 1, wherein the microstructure data stored therein is used to modulate visual presentations with respect to their shapes, colors, brightness and movement concurrently with the production of sound.

* * * * *

UNITED STATES PATENT AND TRADEMARK OFFICE

CERTIFICATE OF CORRECTION

PATENT NO. : 4,704,682

DATED : November 3, 1987

INVENTOR(S) : Manfred Clynes

It is certified that error appears in the above-identified patent and that said Letters Patent is hereby corrected as shown below:

Column 24, line 37, "data" should read -- beta --.

Signed and Sealed this

Twenty-ninth Day of March, 1988

*Attest:*

DONALD J. QUIGG

*Attesting Officer*

*Commissioner of Patents and Trademarks*